US005826275A

United States Patent [19]

Rachel et al.

[11] Patent Number: 5,826,275

[45] Date of Patent: Oct. 27, 1998

[54] NECKWEAR CONSTRUCTION

[75] Inventors: Jeffrey L. Rachel, Siler; Jerry E. Snider, Albemarle, both of N.C.; Allan S. Lerner, New York, N.Y.; Lex L. Basinger, Concord, N.C.

[73] Assignee: Collins & Aikman Products Co., Charlotte, N.C.

[21] Appl. No.: 329,173

[22] Filed: Oct. 26, 1994

[51] Int. Cl.[6] ..... A41D 25/00; A41D 25/16; A41D 27/00; A41D 27/02

[52] U.S. Cl. ..... 2/144; 2/146; 2/243.1; 139/410; 139/413; 139/415

[58] Field of Search ..... 2/44, 92, 267, 2/268, 310, 311, 312, 338, 243.1, 144, 145, 146, 147, 148, 149, 150, 151, 152.1, 153, 154, 155.1, 156, 157; 450/155; 139/413, 410, 414, 415

[56] References Cited

U.S. PATENT DOCUMENTS

| | | | |
|---|---|---|---|
| Re. 30,950 | 6/1982 | Ackerman | 2/144 |
| 543,208 | 7/1895 | Gledhill | 139/415 |
| 658,293 | 9/1900 | Stevenson | 139/410 |
| 1,061,764 | 5/1913 | Marcus . | |
| 1,062,143 | 5/1913 | Cardot . | |
| 1,186,612 | 6/1916 | Satinover . | |
| 1,593,299 | 7/1926 | Goldberg . | |
| 1,756,901 | 4/1930 | Moore . | |
| 1,792,453 | 2/1931 | Thomas . | |
| 1,809,594 | 6/1931 | McCurrach . | |
| 1,827,313 | 10/1931 | Friedman . | |
| 2,126,835 | 8/1938 | Steinberger | 2/146 |
| 2,204,094 | 6/1940 | Meier | 130/413 |
| 2,311,460 | 2/1943 | Naftali | 2/146 |
| 2,749,947 | 6/1956 | Slough | 139/410 |
| 2,800,661 | 7/1957 | Bergheim | 2/146 |
| 3,426,360 | 2/1969 | Ackerman | 2/146 |
| 3,562,814 | 2/1971 | Ackerman | 2/146 |
| 3,824,627 | 7/1974 | Schon et al. | 2/146 |
| 4,123,802 | 11/1978 | Ackerman | 2/144 |
| 4,229,834 | 10/1980 | Alexander et al. | 2/146 |
| 4,506,389 | 3/1985 | Franklin | 2/144 |
| 5,044,013 | 9/1991 | Ackerman | 2/144 |
| 5,142,703 | 9/1992 | Basinger et al. | 2/144 |
| 5,463,779 | 11/1995 | Pinkus | 2/144 |

*Primary Examiner*—Jeanette E. Chapman
*Attorney, Agent, or Firm*—Bell, Seltzer, Park & Gibson

[57] ABSTRACT

The present invention provides a one-piece multidimensional lining carried within an outer fabric casing and lying substantially coextensively along the length thereof. The lining is formed of a double cloth fabric having a first fabric layer and a second fabric layer, the first fabric layer and second fabric layer being of similar or dissimilar constructions and being joined by interlacing warp or filling yarns or both in two planes.

12 Claims, 3 Drawing Sheets

NECKWEAR CONSTRUCTION

FIELD OF THE INVENTION

The present invention relates to neckwear including neckties, cravats, scarfs, and the like, and particularly to a fabric lining of the neckwear.

BACKGROUND OF THE INVENTION

Neckwear typically includes an inner fabric lining or linings contained within the outer casing of the neckwear. This inner fabric lining provides strength and support to the neckwear and should be constructed to resist wrinkling and creasing at least in the neckband and knotting area where the greatest resiliency and strength are needed.

Prior art neckwear generally has been constructed with one of three different types of linings. In the first, a one-piece lining extends the length of the neckwear. In the second, a two-piece lining consisting of two separate and unjoined lining fabrics, or a double lining overlapped or sewn together, extends through the casing. Such constructions are proposed, for example, in U.S. Pat. Nos. 3,426,360 and 3,562,814 to Ackerman. In the third, a second lining piece in the form of a tape, fabric, or other material is superimposed onto the portion of the base piece of lining laying coextensive with the neckband and knotting area of the neckwear outer case as described in 4,229,834 to Alexander. The desired weight, hand, resiliency, and knotting characteristics of the neckwear in the neckband and knotting area are obtained by the choice of the second lining piece.

There, however, remains a need for a lining construction, and particularly a double cloth lining construction wherein slippage, wrinkling, or delamination is avoided between the two cloths during wet or dry finishing, and cutting and sewing in the manufacture process.

SUMMARY OF THE INVENTION

To this end, the present invention provides a one-piece multidimensional lining carried within an outer fabric casing and lying substantially coextensively along the length thereof. The lining is formed of a double cloth fabric having a first fabric layer and a second fabric layer, the first fabric layer and second fabric layer being joined by interlacing warp yarns or filling yarns or both in two planes. Such interlacing eliminates the need for a binder yarn to join the fabric layers. In one embodiment, the first fabric layer and second fabric layer are dissimilar constructions, namely the layers can have different fiber/yarn content, weaves, yarn counts, weights, etc . . . . Thus the lining may incorporate the desired properties of different constructions and of different fiber blends.

The present invention also provides neckwear formed from a one-piece textile fabric in which the central neckband and knotting portion of the lining may be constructed to have different fabric characteristics than the fabric characteristics of the end portions of the lining wherein the central portion comprises a double cloth fabric construction having a first fabric layer and a second fabric layer, the first fabric layer and second fabric layer being joined by interlacing warp yarns or filling yarns or both in two planes, and the knotting portion is a single woven fabric. Conversely, the knotting portion can be the double cloth fabric construction and the central portion can be the single woven fabric. The first fabric layer and second fabric layer can be disimilar constructions.

BRIEF DESCRIPTION OF THE INVENTION

The present invention will now be described in greater detail hereinbelow. This invention may be embodied in many forms and should not be construed as limited to the embodiments set forth herein; instead, these embodiments are provided so that this disclosure will be thorough and complete, and will fully convey the scope of the invention to those skilled in the art.

Figure 1:
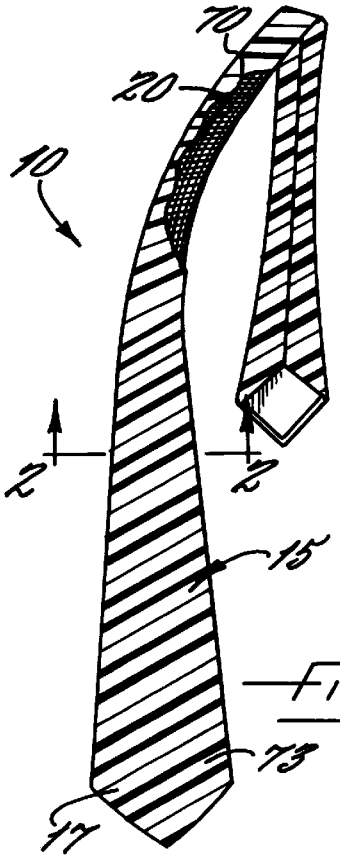
FIG. 1 is an isometric view of a necktie in accordance with the invention.
Figure 2:
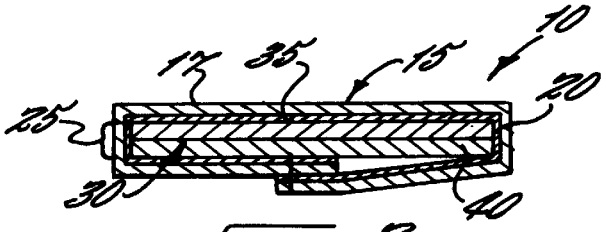
FIG. 2 is a cross-sectional view of the necktie of FIG. 1 taken along the line 2—2 of FIG. 1.

Referring to FIG. 1, neckwear such as a necktie 10 is illustrated. The necktie 10 comprises an outer fabric casing 15 having an outer surface or face 17 and a back surface 20. The outer fabric casing is manufactured using conventional techniques. The casing 15 is typically woven from silk, polyester, or other conventional fiber or blend thereof, and then cut along the bias. As shown in FIG. 2, the necktie 10 includes a multidimensional lining 25. The lining generally is formed of a double cloth fabric 30 formed from a first fabric layer 35 and a second fabric layer 40. The lining 25 is initially positioned flat on the casing 15, and the casing 15 is then wrapped and sewn around the lining 25. It is recognized that the lining 25 may be inserted within a completed tube forming the casing 15. Exemplary fabrication techniques are described, for example, in U.S. Pat. Nos. 3,426,360 and 3,562,814 to Ackerman, the disclosures of which are incorporated herein in their entirety.

Figure 3:
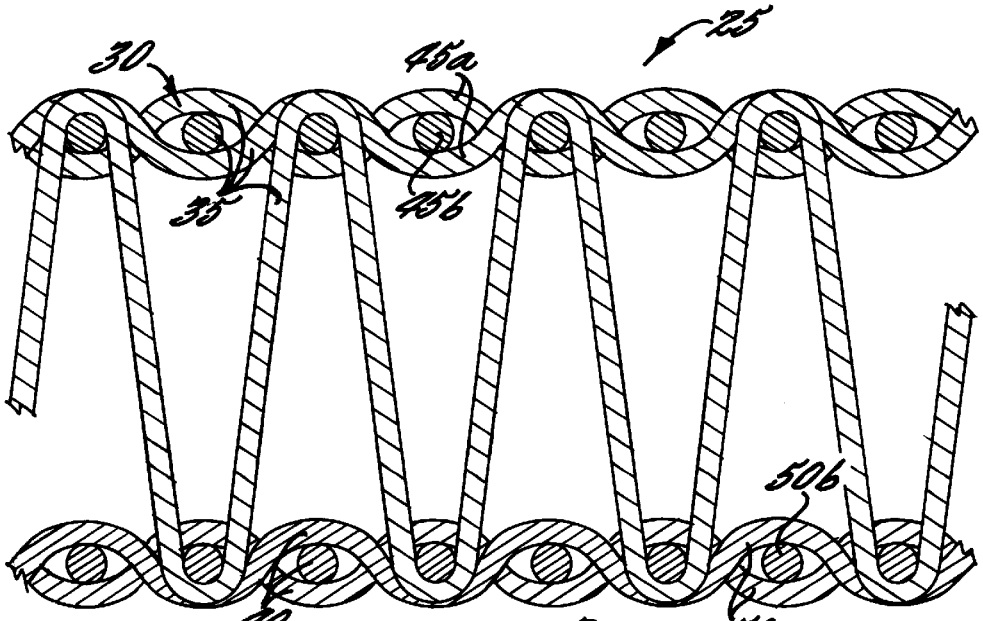
FIG. 3 is an enlarged, fragmentary plan view of one embodiment of the double cloth fabric lining wherein the first fabric layer comprises warp yarns and filling yarns of a first fiber type and the second fabric layer comprises warp and filing yarns of a second fiber type.
Figure 4:
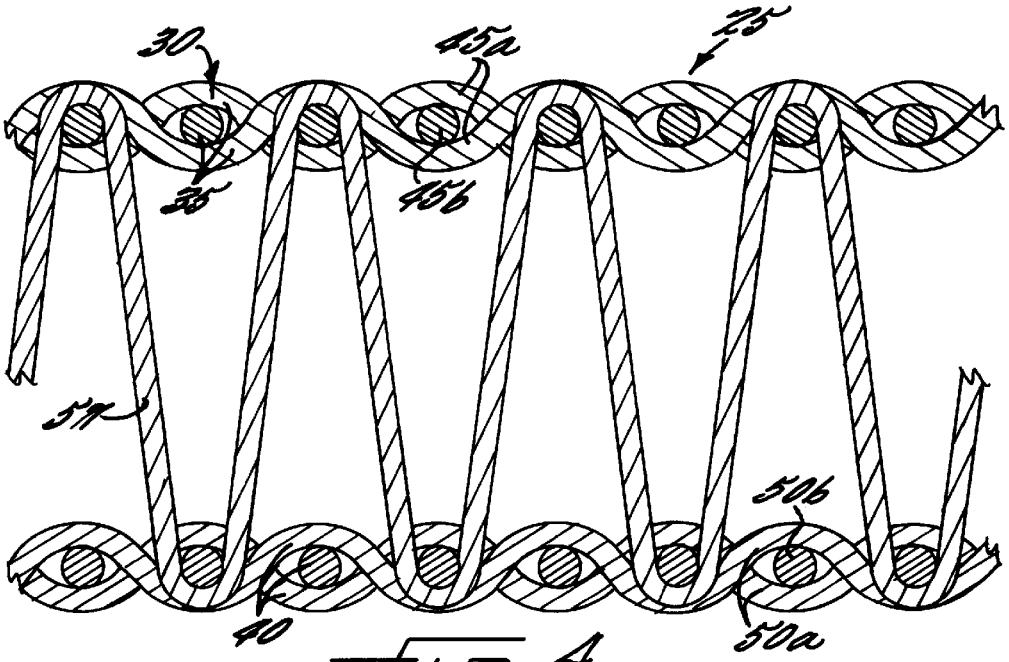
FIG. 4 is an enlarged, fragmentary plan view of another embodiment of the lining in which the first fabric layer comprises warp yarns of a first fiber type and filling yarns of a second fiber type, and the second fabric layer comprises warp yarns of a third fiber type and filling yarns of a fourth fiber type.
Figure 5:
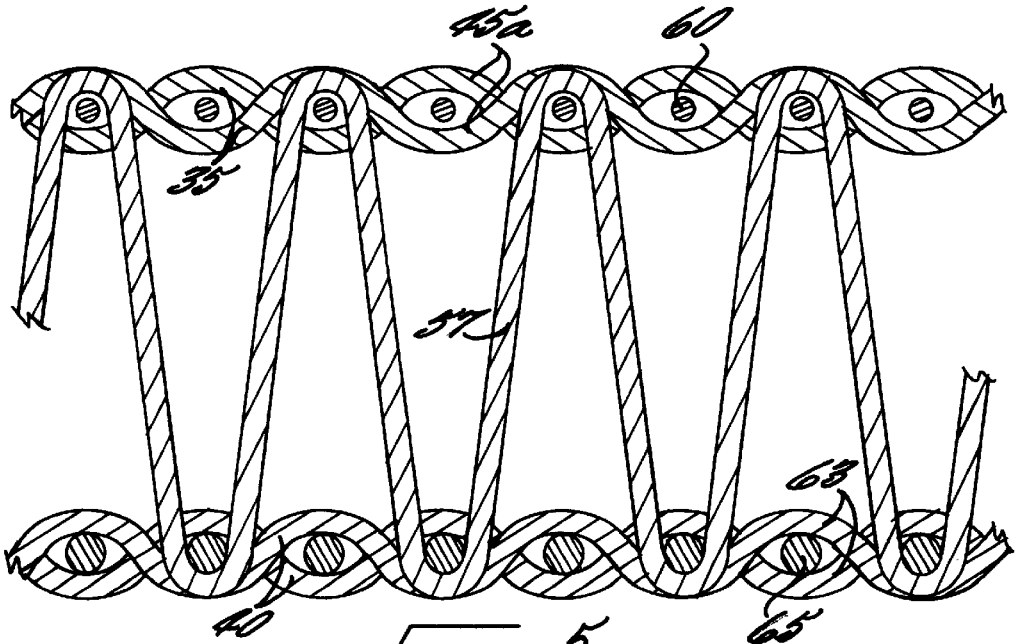
FIG. 5 is an enlarged, fragmentary plan view of another embodiment of the lining in which the first fabric layer and second fabric layer are joined by interlacing warp yarns of a third fiber type.

Referring now to FIGS. 3 through 5, various constructions of the lining 25 are shown. In general, the lining 25 comprises a double cloth fabric 30 having a first fabric layer 35 and a second fabric layer 40 joined by interlacing warp yarns or filling yarns or both in two planes which eliminates the need for a binder yarn such as required in U.S. Pat. No. 4,229,834 to Alexander et al.

The first fabric layer and second fabric layer can be dissimilar constructions. For example, the fabric layers may be formed from a plurality of open-end spun yarns, ring-spun yarns, filament yarns, or other yarns produced by any conventional yarn manufacturing technology. The layers may be formed from a plurality of different fiber blend combinations. For example, more expensive and resilient wool can be added to polyester to impart better recovery and strength to one or both of the layers. Alternatively different quality yarns of the same fiber can be used. Different yarn counts can be used. The fabric layers could also have different weights.

The fabrics are woven using conventional looms such as dobby and Jacquard head looms, the selection and operation of will be within the skill of one in the art. Suitable weaves include plain weaves, twill weaves, sateen weaves, drill weaves, satin weaves, granite weaves and the like and derivatives thereof.

As shown in FIG. 3, the first fabric layer 35 of the double cloth fabric 30 may comprise warp yarns 45*a* and filling yarns 45*b* of a first fiber type (e.g., polyester). The second fabric layer comprises warp yarns 50*a* and filling yarns 50*b* of a second fiber type (e.g., acrylic). Suitable first and second fiber types include most natural and synthetic fibers such as wool, polyester, nylon, acrylic, cotton, viscose, and the like, the selection of which will be within the skill of one in the art.

The first fabric layer 35 and second fabric layer 40 are positioned one above the other with the warp yarns 45*a* and filling yarns 45*b* of the first fabric layer 35 extending in the same direction as the corresponding warp yarns 50*a* and filling yarns 50*b* of the second fabric layer 40. The first fabric layer 35 and second fabric layer 40 are joined together by interlacing the warp yarns 45*a* or filing yarns or both of either the first fiber type (as shown) or the second fiber type (not shown). The yarns are interlaced in two planes on a controlled plan to provide a balanced, nontorqued lining.

In another embodiment as shown in FIG. 4, the connecting warp yarn 57 (as shown) or filling yarn (not shown) may be a third fiber type. In still another embodiment as shown in FIG. 5, the first fabric layer 35 can comprise warp yarns 45*a* of a first fiber type and filling yarns 60 of a second fiber type, and the second fabric layer 40 can comprise warp yarns 63 of a third fiber type and filler yarns of a fourth fiber type 65. The layers 35, 40 are interlaced in two planes by a warp yarn 57 or filler yarn of a different or the same construction as the other wrap yarns or filler yarns.

Figure 6:
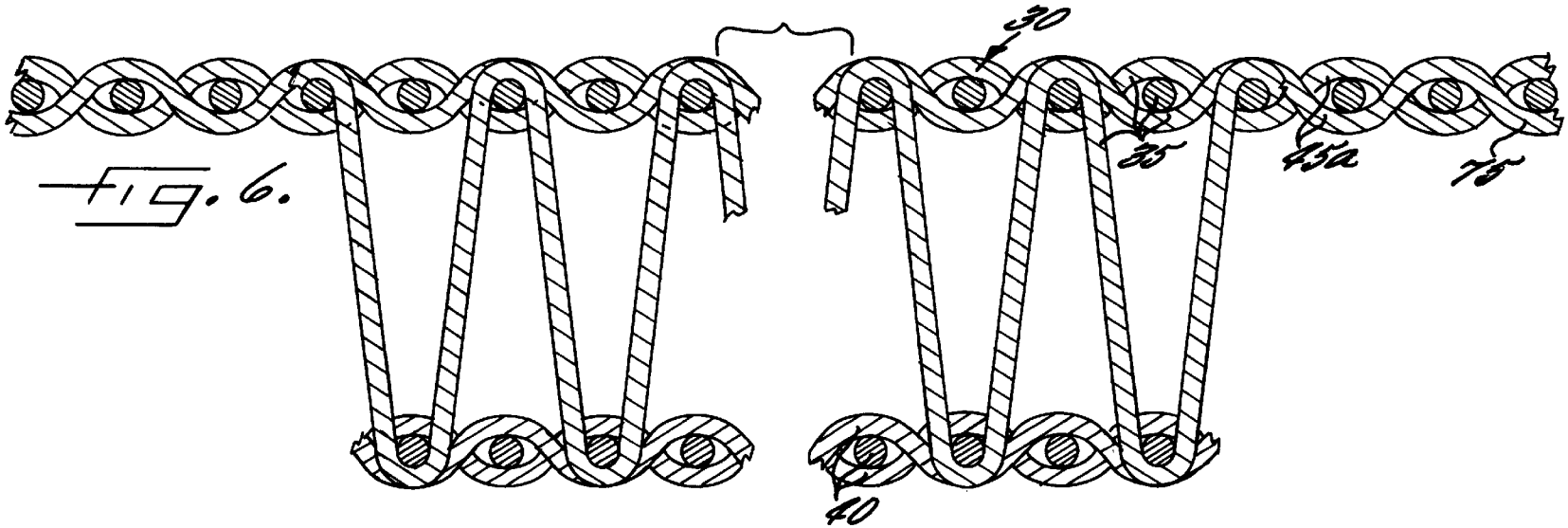
FIG. 6 is an enlarged, fragmentary sectional view of another embodiment of the lining in which the central portion of the lining is formed of a double cloth fabric comprising a first fabric layer and a second fabric layer in accordance with the invention.

In an alternate embodiment, some fashions require a small or large knot. Thus the central and knotting portion 70 of the tie is preferably thinner or thicker than the end portions 73 of the necktie. Referring to FIG. 6 in one embodiment, the lining is formed of a one-piece textile fabric cut substantially along the bias as described in U.S. Pat. No. 5,142,703 to Basinger et al., the disclosure of which is incorporated therein by reference in its entirety. The end portions 73 are formed of a single woven fabric 75, and the central portion 70 is formed of the double cloth fabric 30 of the invention, namely the double cloth fabric comprises a first fabric layer 35 and a second fabric layer 40 of similar or dissimilar constructions joined by interlacing warp yarns 45*a* or filling yarns or both.

Figure 7:
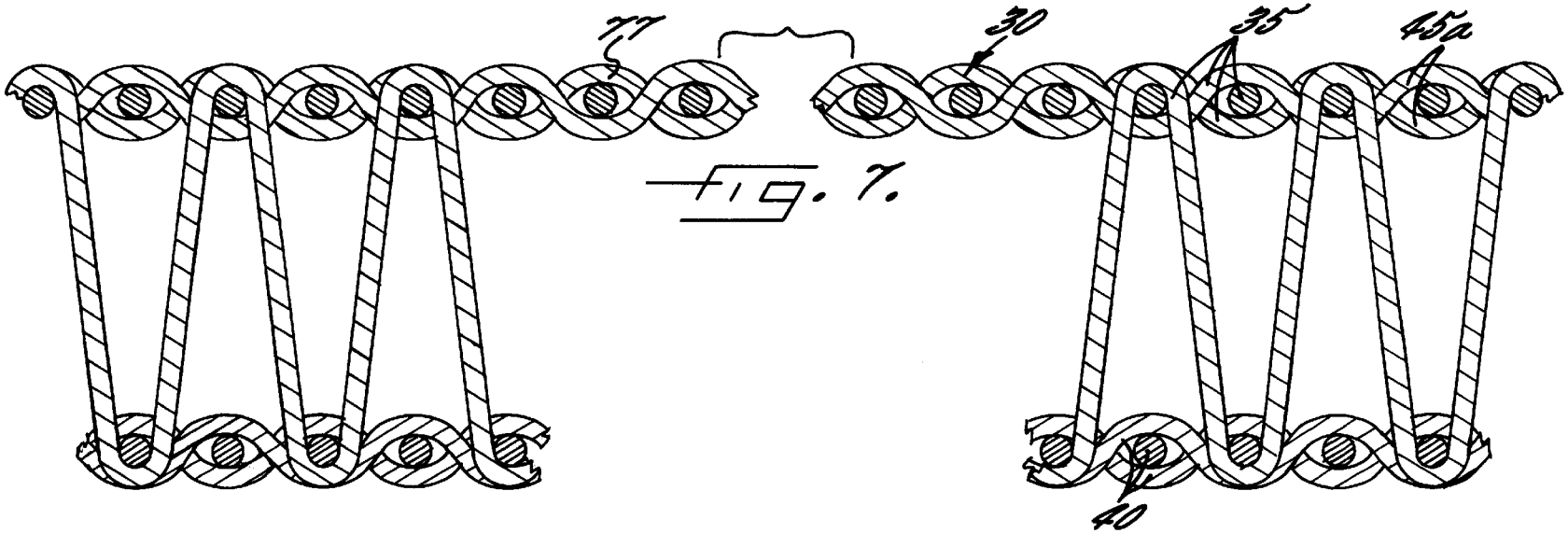
FIG. 7 is an enlarged, fragmentary sectional view of still another embodiment of the lining in which the knotting portion of the lining is formed of a double cloth fabric comprising a first fabric layer and a second fabric layer in accordance with the invention.

As shown in FIG. 7, the end portions 73 can be formed of the double cloth fabric 30 formed of first fabric layer 35 and a second fabric layer 40 of dissimilar constructions joined by interlacing warp yarns 45*a* or filling yarns or both, and the central portion is formed of a single woven fabric 77.

The foregoing embodiments are illustrative of the present invention, and are not to be construed as limiting thereof. The invention is defined by the following claims, with equivalents of the claims to be included therein.

That which is claimed is:

1. A neckwear comprising an outer fabric casing and a one-piece multi-dimensional non-torqued lining carried within the casing and layered substantially coextensively along the length of said casing, the lining being formed of a double cloth fabric having a first fabric layer and a second fabric layer being of dissimilar constructions, and being joined by at least one of interlacing warp yarns or filling yarns in two planes, wherein said double cloth lining is constructed of smooth fabrics suitable for lining neckwear, and wherein the first fabric layer comprises warp and weft yarns and filling yarns of a first fabric type, and the second fabric layer comprises warp and weft yarns of a second fiber type, and the first fabric layer and second fabric layer are joined by interlacing a warp yarn of a third fiber type in two planes.

2. A neckwear comprising an outer fabric casing and one-piece multidimensional lining carried within the casing and layered substantially coextensively along the length of said casing, the lining being formed of a double cloth fabric having a first fabric layer and a second fabric layer and being joined by at least one of interlacing warp yarns or filling yarns in two planes, wherein the first fabric layer comprises warp yarns and filling yarns of a first fiber type, and the second fabric layer comprises warp yarns and filling yarns of a second fiber type, and the first fabric layer and the second fabric layer are joined by interlacing a warp yarn of a third fiber type in two planes.

3. A neckwear comprising an outer fabric casing and one-piece multidimensional lining carried within the casing and layered substantially coextensively along the length of said casing, the lining being formed of a double cloth fabric having a first fabric layer and a second fabric layer, wherein the first fabric layer comprises warp yarns of a first fiber type and filling yarns of a second fiber type, and the second fabric layer comprises warp yarns of a third fiber type and filling yarns of a fourth fiber type.

4. In a neckwear comprising an outer fabric layer and a one-piece multidimensional lining carried within the outer fabric layer and layered substantially coextensively along the length of said outer fabric layer, the improvement comprising the use of a lining being formed of first and second fabric layers of dissimilar constructions, wherein the first fabric layer comprises warp yarns and filling yarns of a first fiber type, and the second fabric layer comprises warp yarns and filling yarns of a second fiber type, and the first fabric layer an second fabric layer are joined by interlacing a warp yarn of a third fiber type.

5. In a neckwear according to claim 4, wherein the first and second layers are joined by interlacing at least one of warp yarns or filling yarns in two planes.

6. In a neckwear comprising an outer fabric layer and a one-piece multidimensional lining carried within the outer fabric layer and layered substantially coextensively along the length of said outer fabric layer, the improvement comprising the use of a lining being formed of first and second fabric layers of dissimilar constructions, wherein the first fabric layer comprises warp yarns of a first fiber type and filling yarns of a second fiber type, and the second fabric layer comprises warp yarns of a third fiber type and filling yarns of a fourth fiber type.

7. A neckwear comprising an outer fabric casing and one-piece multidimensional lining carried within the casing and layered substantially coextensively along the length of said casing, the lining being formed of a double cloth fabric having a first fabric layer and a second fabric layer, and being joined by interlacing at least one of warp yarns or filling yarns in two planes, wherein the first fabric layer comprises warp yarns and filling yarns of a first fiber type, and the second fabric layer comprises warp yarns and filling yarns of a second fiber type, and the first fabric layer and second fabric layer are joined by interlacing a warp yarn of a third fiber in two planes.

8. A neckwear comprising an outer fabric casing and one-piece multidimensional lining carried within the casing and layered substantially coextensively along the length of said casing, the lining being formed of a double cloth fabric having a first fabric layer and a second fabric layer, and being joined by interlacing at least one of warp yarns or filling yarns in two planes, wherein the first fabric layer comprises warp yarns of a first fiber type and filling yarns of a second fiber type, and the second fabric layer comprises warp yarns of a third fiber type and filling yarns of a fourth fiber type.

9. A neckwear comprising an outer fabric casing, a one-piece, multidimensional lining having opposing end portions and having a central neckband and knotting portion positioned between said end portions, said lining being carried within said casing and lying substantially coextensively with said casing along the length thereof, said lining being formed of a one piece textile fabric cut substantially along the bias and wherein the central portion of said lining is formed of a double cloth fabric being formed of first and second fabric layers of dissimilar constructions joined by interlacing at least one of warp yarns or filling yarns, and the end portions of the lining are formed of a single woven fabric, wherein the first fabric layer comprises warp yarns and filling yarns of a first fiber type, and the second layer comprises warp yarns and filling yarns of a second fiber type, and the first fabric layer and second fabric layer are joined by interlacing a warp yarn of a third fiber type.

10. A neckwear comprising an outer fabric casing, a one-piece, multidimensional lining having opposing end portions and having a central neckband and knotting portion positioned between said end portions, said lining being carried within said casing and lying substantially coextensively with said casing along the length thereof, said lining being formed of a one piece textile fabric cut substantially along the bias and wherein the central portion of said lining is formed of a double cloth fabric being formed of first and second fabric layers of dissimilar constructions joined by interlacing at least one of warp yarns or filling yarns, and the end portions of the lining are formed of a single woven fabric, wherein the first fabric layer comprises warp yarns of a first fiber type and filling yarns of a second fiber type, and the second fabric layer comprises warp yarns of a third fiber type and filling yarns of a fourth fiber type.

11. A neckwear comprising an outer fabric casing, a one-piece, multidimensional lining having opposing end portions and having a central neckband and knotting portion positioned between said end portions, said lining being carried within said casing and lying substantially coextensive with said casing along the length thereof, said lining being formed of a one-piece textile fabric cut substantially along the bias and wherein said lining is formed of a double cloth fabric being formed of first and second fabric layers of dissimilar constructions joined by interlacing at least one of warp or filling yarns, wherein the first fabric layer comprises warp and filling yarns of a first fiber type, and the second fabric layer comprises warp yarns and filling yarns of a second fiber type, and the first fabric layer and second fabric layer are joined by interlacing a warp yarn of a third fiber type.

12. A neckwear comprising an outer fabric casing, a one-piece, multidimensional lining having opposing end portions and having a central neckband and knotting portion positioned between said end portions, said lining being carried within said casing and lying substantially coextensive with said casing along the length thereof, said lining being formed of a one-piece textile fabric cut substantially along the bias and wherein said lining is formed of a double cloth fabric being formed of first and second fabric layers of dissimilar constructions joined by interlacing at least one of warp or filling yarns, and, wherein the first fabric layer comprises warp yarns of a first fiber type and filling yarns of a second fiber type, and the second fabric layer comprises warp yarns of a third fiber type and filling yarns of a fourth fiber type.

* * * * *